US011325373B2

(12) United States Patent
Kondo

(10) Patent No.: US 11,325,373 B2
(45) Date of Patent: May 10, 2022

(54) INKJET PRINTER

(71) Applicant: Brother Kogyo Kabushiki Kaisha, Nagoya (JP)

(72) Inventor: Tomoya Kondo, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 5 days.

(21) Appl. No.: 16/508,623

(22) Filed: Jul. 11, 2019

(65) Prior Publication Data

US 2020/0016891 A1 Jan. 16, 2020

(30) Foreign Application Priority Data

Jul. 12, 2018 (JP) ..... JP2018-132521

(51) Int. Cl.
*B41J 2/045* (2006.01)

(52) U.S. Cl.
CPC ..... *B41J 2/04558* (2013.01); *B41J 2/04536* (2013.01); *B41J 2/04586* (2013.01)

(58) Field of Classification Search
None
See application file for complete search history.

(56) References Cited

U.S. PATENT DOCUMENTS 6,547,363 B1 * 4/2003 Shinada ..... B41J 2/17503 347/19
8,233,190 B2 * 7/2012 Bostick ..... H04N 1/62 358/1.9
8,690,286 B2 * 4/2014 Aoyama ..... B41J 2/17566 347/19

FOREIGN PATENT DOCUMENTS

JP 2003-011392 A 1/2003
JP 2004-050504 A 2/2004

* cited by examiner

*Primary Examiner* — Alejandro Valencia
(74) *Attorney, Agent, or Firm* — Banner & Witcoff, Ltd.

(57) ABSTRACT

An inkjet printer includes: a print execution unit that executes printing; and a controller that controls the print execution unit. The controller is configured to: determine whether a type of ink supplied by the ink supply unit is changed; determine whether to use a residual ink which is ink before change remaining in the ink flow path in response to be determined that the type of the ink is changed; control the print execution unit to execute new printing using the residual ink in response to be determined to use the residual ink for the printing; and execute a discarding process for discarding the residual ink before the new printing is performed in response to be determined to not use the residual ink for the printing.

3 Claims, 5 Drawing Sheets

*FIG. 2*

| | | TYPE OF INK | |
|---|---|---|---|
| | | FIRST TYPE (e.g. DYE) | SECOND TYPE (e.g. PIGMENT) |
| TYPE OF SHEET | PLAIN SHEET | B | A |
| | GLOSSY SHEET | A | C |

INKJET PRINTER

CROSS-REFERENCE TO RELATED APPLICATION

This application claims priorities from Japanese Patent Application No. 2018-132521 filed on Jul. 12, 2018, the entire subject matters of which is incorporated herein by reference.

TECHNICAL FIELD

The present specification relates to a printer that prints an image by using ink.

BACKGROUND

Inkjet printers that print images by using ink are known. The inkjet printer is capable to utilize a plurality of types of print media such as matte sheet, plain sheet, and glossy sheet. Herein, a technology that uses a plurality of types of ink in one printing apparatus has been proposed. For example, a plurality of ink cartridges filled with different types of ink corresponding to a plurality of types of print media are prepared. Then, the ink cartridges suitable for the print media are mounted in the printing apparatus.

According to the above technology, when the type of ink has been changed, a cleaning operation more intensive than a normal cleaning operation is performed in order to prevent different types of ink from being mixed. However, in some cases, the ink cannot be effectively used for the printing due to an increase in a discarding amount of ink caused by the cleaning operation.

SUMMARY

The present disclosure has been made in view of the above circumstances, and one of objects of the present disclosure is to provide an inkjet printer which can effectively use ink for printing.

According to an illustrative embodiment of the present disclosure, there is provided an inkjet printer including: a print execution unit that executes printing; and a controller that controls the print execution unit. The print execution unit includes: a print head having a plurality of nozzles configured to eject ink; an ink supply unit that is configured to supply ink to the print head; and an ink flow path that connects the ink supply unit and the print head. The controller is configured to: determine whether a type of ink supplied by the ink supply unit is changed; determine whether to use a residual ink which is ink before change remaining in the ink flow path in response to be determined that the type of the ink is changed; control the print execution unit to execute new printing using the residual ink in response to be determined to use the residual ink for the printing; and execute a discarding process for discarding the residual ink before the new printing is performed in response to be determined to not use the residual ink for the printing.

BRIEF DESCRIPTION OF THE DRAWINGS

In the accompanying drawings:

FIG. 2 is a table illustrating an example of a correspondence relationship between a type of sheet, a type of ink, and suitability;

DETAILED DESCRIPTION

A. First Embodiment

Figure 1:
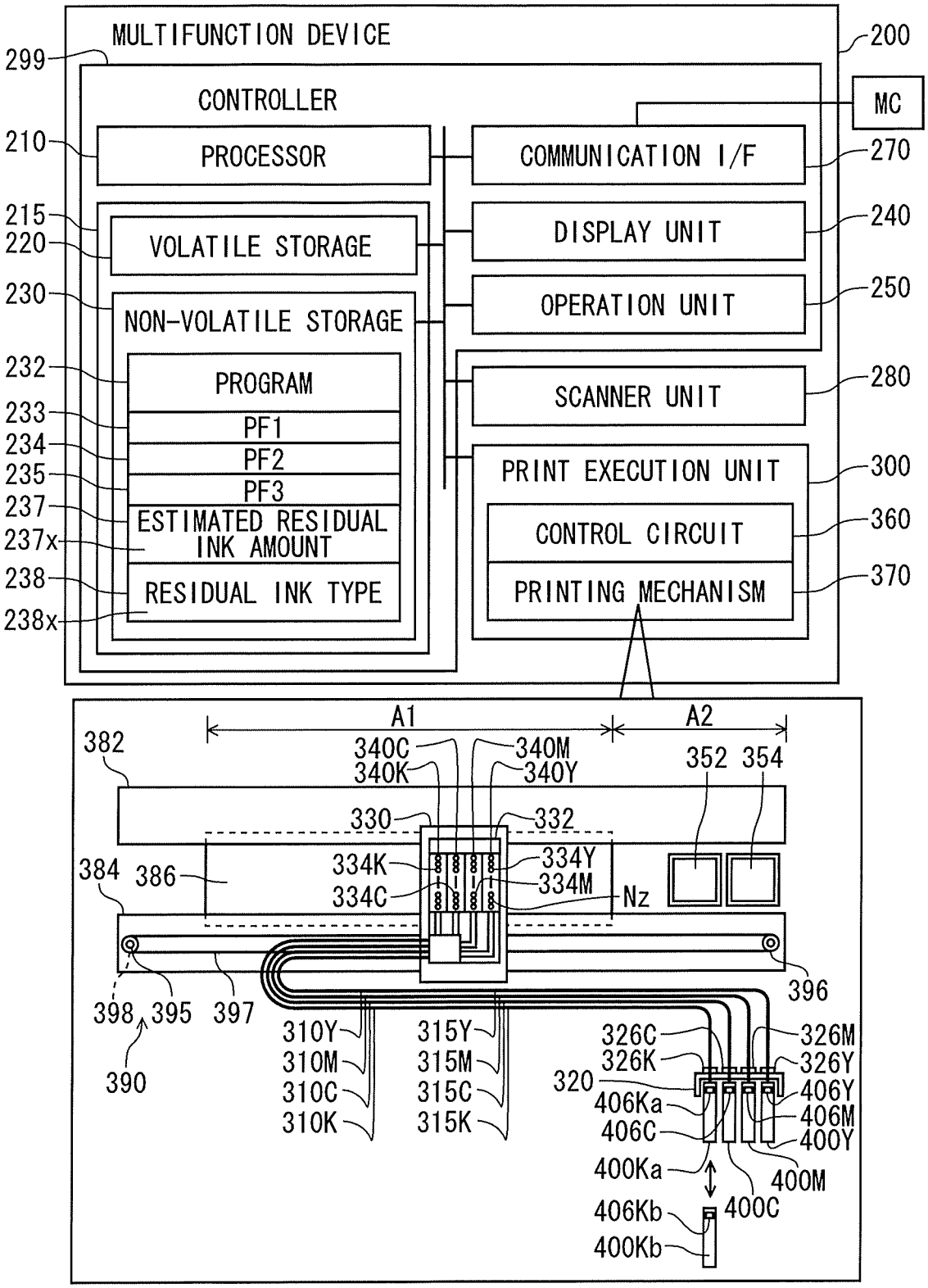
FIG. 1 is an explanatory diagram illustrating a multifunction device as an embodiment.

FIG. 1 is an explanatory diagram illustrating a multifunction device as an embodiment. A multifunction device 200 includes a controller 299, a scanner unit 280, and a print execution unit 300. The controller 299 includes a processor 210, a storage device 215, a display unit 240, an operation unit 250, and a communication interface 270. The components of the multifunction device 200 are connected to one another through a bus. The storage device 215 includes a volatile storage 220 and a non-volatile storage 230.

The processor 210 is a device that performs data processing and is, for example, a CPU. The volatile storage 220 is, for example, a DRAM, and the non-volatile storage 230 is, for example, a flash memory.

The non-volatile storage 230 stores a program 232, a first profile 233, a second profile 234, a third profile 235, estimated residual ink amount information 237, and residual ink type information 238. Details of these pieces of information will be described later. The processor 210 implements various functions by executing the program 232 (details will be described later). The processor 210 temporarily stores various intermediate data used to execute the program 232 in a storage device (for example, any of the volatile storage 220 and the non-volatile storage 230). In the present embodiment, the program 232 and the profiles 233, 234, and 235 are stored in advance in the non-volatile storage 230 as firmware by the manufacturer of the multifunction device 200.

The display unit 240 is a device configured to display an image and is, for example, a liquid crystal display. The operation unit 250 is a device configured to receive an operation by a user and is, for example, a touch panel disposed to overlap on the display unit 240. The user can input various instructions to the multifunction device 200 by operating the operation unit 250. The display unit 240 may be other type of device that displays an image, such as an LED display or an organic EL display. The operation unit 250 may be other type of device operated by the user, such as a button or a lever.

The communication interface 270 is an interface for communicating with another device. In the present embodiment, the communication interface 270 includes a USB interface. A memory card MC storing image data for the printing can be mounted in the communication interface 270. The communication interface 270 may include a network interface such as a wired LAN interface or an IEEE 802.11 wireless interface.

The scanner unit 280 generates scan data representing a read image (referred to as a "scan image") by optically reading an object such as a document by using a photoelectric conversion element such as a CCD or a CMOS. The scan data is, for example, RGB bitmap data representing a color scan image.

The print execution unit 300 is a device that prints an image on sheet (an example of a print medium). The print execution unit 300 includes a printing mechanism 370 and a control circuit 360 configured to control the printing mechanism 370. In the present embodiment, the printing mechanism 370 is an inkjet-type printing mechanism.

In the lower portion of FIG. 1, an example of the printing mechanism 370 is illustrated. In FIG. 1, a schematic view of the printing mechanism 370 as viewed from the above is illustrated. The printing mechanism 370 includes a pair of guide rails 382 and 384 that are disposed substantially in parallel, a pair of pulleys 395 and 396, a belt 397 that is wound around the pulleys 395 and 396 and extends substantially in parallel with the pair of guide rails 382 and 384, a carriage motor 398 that rotates the pulley 395, and a carriage unit 330 that is slidably supported by the guide rails 382 and 384 and is bonded to the belt 397. The carriage motor 398 rotates the pulley 395 in the forward or reverse direction. The rotation of the pulley 395 causes the belt 397 to reciprocate, and the carriage unit 330 reciprocates along the guide rails 382 and 384. Hereinafter, the moving direction of the carriage unit 330 (that is, the extending direction of the guide rails 382 and 384) is also referred to as a scanning direction. The movable area of the carriage unit 330 includes a recording area A1 for recording an image on sheet and a maintenance area A2 for maintenance of the carriage unit 330.

The carriage unit 330 includes a print head 332, and buffer tanks 340K, 340C, 340M, and 340Y connected to the print head 332. The buffer tanks 340K, 340C, 340M, and 340Y temporarily store the ink of black K, cyan C, magenta M, and yellow Y, respectively. The print head 332 includes four nozzle rows 334K, 334C, 334M, and 334Y configured to eject ink. The nozzle rows 334K, 334C, 334M, and 334Y are provided below the print head 332, but are illustrated as solid lines in FIG. 1 for the description. Each of the nozzle rows 334K, 334C, 334M, and 334Y is configured with a plurality of nozzles Nz different in position in the direction perpendicular to the scanning direction. The nozzle rows 334K, 334C, 334M, and 334Y are connected to the buffer tanks 340K, 340C, 340M, and 340Y, respectively. The nozzle rows 334K, 334C, 334M, and 334Y eject ink droplets of black K, cyan C, magenta M, and yellow Y, respectively. Although not illustrated, the print head 332 is provided with a driving device (for example, a piezo element or a heater) for ejecting ink droplets for each nozzle Nz.

The printing mechanism 370 further includes a cartridge mounting unit 320, ink supply tubes 310K, 310C, 310M, and 310Y, a platen 386, a capping device 352, and a waste ink receiving tray 354.

In the cartridge mounting unit 320, ink cartridges 400Ka (400Kb), 400C, 400M, and 400Y of black K, cyan C, magenta M, and yellow Y are detachably mounted. In the present embodiment, ink cartridges 400C, 400M, and 400Y of cyan C, magenta M, and yellow Y contain dye ink, respectively. As the ink cartridge of black K, a cartridge arbitrarily selected from a first type ink cartridge 400Ka for containing dye ink and a second type ink cartridge 400Kb for containing pigment ink is mounted.

FIG. 2 is a table illustrating an example of the correspondence relationship between the type of sheet, the type of ink, and the suitability. In the present embodiment, as the sheet, the printing mechanism 370 can use sheet arbitrarily selected from plain sheet and glossy sheet. As the type of black ink, the printing mechanism 370 can use ink arbitrarily selected from a first type ink (herein, a dye) contained in the first type ink cartridge 400Ka and a second type ink (herein, a pigment) contained in the second type ink cartridge 400Kb. The suitability is evaluated in three steps of A (optimal), B (good) and C (not suitable).

In the example of FIG. 2, the suitability of the first type ink is "B" for plain sheet and "A" for glossy sheet. The suitability of the second type ink is "A" for plain sheet and "C" for glossy sheet. As described above, in the present embodiment, when the plain sheet is used, both the first type ink and the second type ink can be used. When the glossy sheet is used, it is recommended to use the first type ink without using the second type ink. The user may change the ink cartridge of black ink installed in the cartridge mounting unit 320 (FIG. 1) according to the type of sheet used for the printing. In CMY, the ink cartridges 400C, 400M, and 400Y of dyes are used regardless of the type of sheet.

As illustrated in FIG. 1, non-contact memories 406Ka, 406Kb, 406C, 406M, and 406Y are fixed to the ink cartridges 400Ka, 400Kb, 400C, 400M, and 400Y. In the memories 406Ka, 406Kb, 406C, 406M, and 406Y, ink information that are information on the ink contained in the ink cartridges 400Ka, 400Kb, 400C, 400M, and 400Y are stored, respectively. The ink information include information (for example, model number) identifying the ink. By using the ink information, the color and type of the ink can be specified. The cartridge mounting unit 320 includes non-contact memory readers (reading unit) 326K, 326C, 326M, and 326Y. The memory readers 326K, 326C, 326M, and 326Y read the ink information from the memory of each ink cartridge of KCMY.

The ink supply tubes 310K, 310C, 310M, and 310Y connect the cartridge mounting unit 320 and the carriage unit 330. The ink supply tubes 310K, 310C, 310M, and 310Y supply the ink of KCMY from the ink cartridges 400Ka (400Kb), 400C, 400M, and 400Y to the buffer tanks 340K, 340C, 340M, and 340Y, respectively. As described above, the ink cartridges 400Ka (400Kb), 400C, 400M, and 400Y are connected to the buffer tanks 340K, 340C, 340M, and 340Y through the ink supply tubes 310K, 310C, 310M, and 310Y, respectively.

The cartridge mounting unit 320 is an example of the ink supply unit configured to supply ink to the print head 332 (hereinafter, the cartridge mounting unit 320 is also referred to as the ink supply unit 320). The whole of the ink supply tubes 310K, 310C, 310M, and 310Y and the buffer tanks 340K, 340C, 340M, and 340Y is an example of the ink flow path connecting the cartridge mounting unit 320 and the print head 332. Hereinafter, the ink flow paths of KCMY are also referred to as ink flow paths 315K, 315C, 315M, and 315Y, respectively. For example, the whole of the black ink supply tube 310K and the black buffer tank 340K corresponds to the ink flow path 315K of black ink.

When the ink cartridge of black ink mounted in the cartridge mounting unit 320 is changed to an ink cartridge of another type of black ink, the old ink which is the ink before the change remains in the ink flow path 315K. As described later, in the printing process of the present embodiment, printing using such old ink (also referred to as residual ink) may be performed.

The residual ink type information 238 indicates the type of ink remaining in the ink flow path 315K. Hereinafter, the type of ink indicated by the residual ink type information 238 is also referred to as a residual ink type 238*x*. When the type of ink is changed, the residual ink type 238*x* indicates the type of old ink before the change. The estimated residual ink amount information 237 indicates an estimated value of the amount of old ink remaining in the ink flow path 315K. Hereinafter, the estimated amount of old ink indicated by the estimated residual ink amount information 237 is also referred to as an estimated residual ink amount 237$x$. These pieces of information 237 and 238 are updated by a printing process described later.

The processor 210 initializes the estimated residual ink amount information 237 and the residual ink type information 238 during initial power-on after shipment of the multifunction device 200. For example, the estimated residual ink amount information 237 is initialized so that the estimated residual ink amount 237$x$ is zero. The residual ink type information 238 is initialized so that the residual ink type 238$x$ indicates the type of ink specified by the ink information read from the memory of the ink cartridge of black ink mounted in the cartridge mounting unit 320.

The platen 386 is disposed below the carriage unit 330 in the recording area A1, and is a plate-shaped member that supports the sheet. During printing, the carriage unit 330 performs a scanning process which is a process of ejecting ink droplets toward sheet (not illustrated) on the platen 386 while moving in the scanning direction, so that an image is recorded on the sheet. The printing mechanism 370 includes a roller (not illustrated) that transports the sheet in a direction (also referred to as a transporting direction) perpendicular to the scanning direction. The printing mechanism 370 prints on the entire sheet by repeating scanning of the carriage unit 330 and transporting of the sheet.

The capping device 352 and the waste ink receiving tray 354 are disposed below the carriage unit 330 in the maintenance area A2. The capping device 352 seals the lower surface of the print head 332 at a position facing the capping device 352 and is configured to execute a purging process for sucking ink or the like from the plurality of nozzles Nz (a suction pump (not illustrated) is connected to the capping device 352). The waste ink receiving tray 354 is a container-shaped member for receiving the ink droplets ejected by the print head 332. The carriage unit 330 can clean the nozzles Nz (also referred to as flushing) by ejecting the ink toward the waste ink receiving tray 354 at a position facing the waste ink receiving tray 354.

The control circuit 360 is an electrical circuit configured to control the printing mechanism 370 according to an instruction from the controller 299. The control circuit 360 is configured by using dedicated hardware such as an application specific integrated circuit (ASIC).

Figure 3:
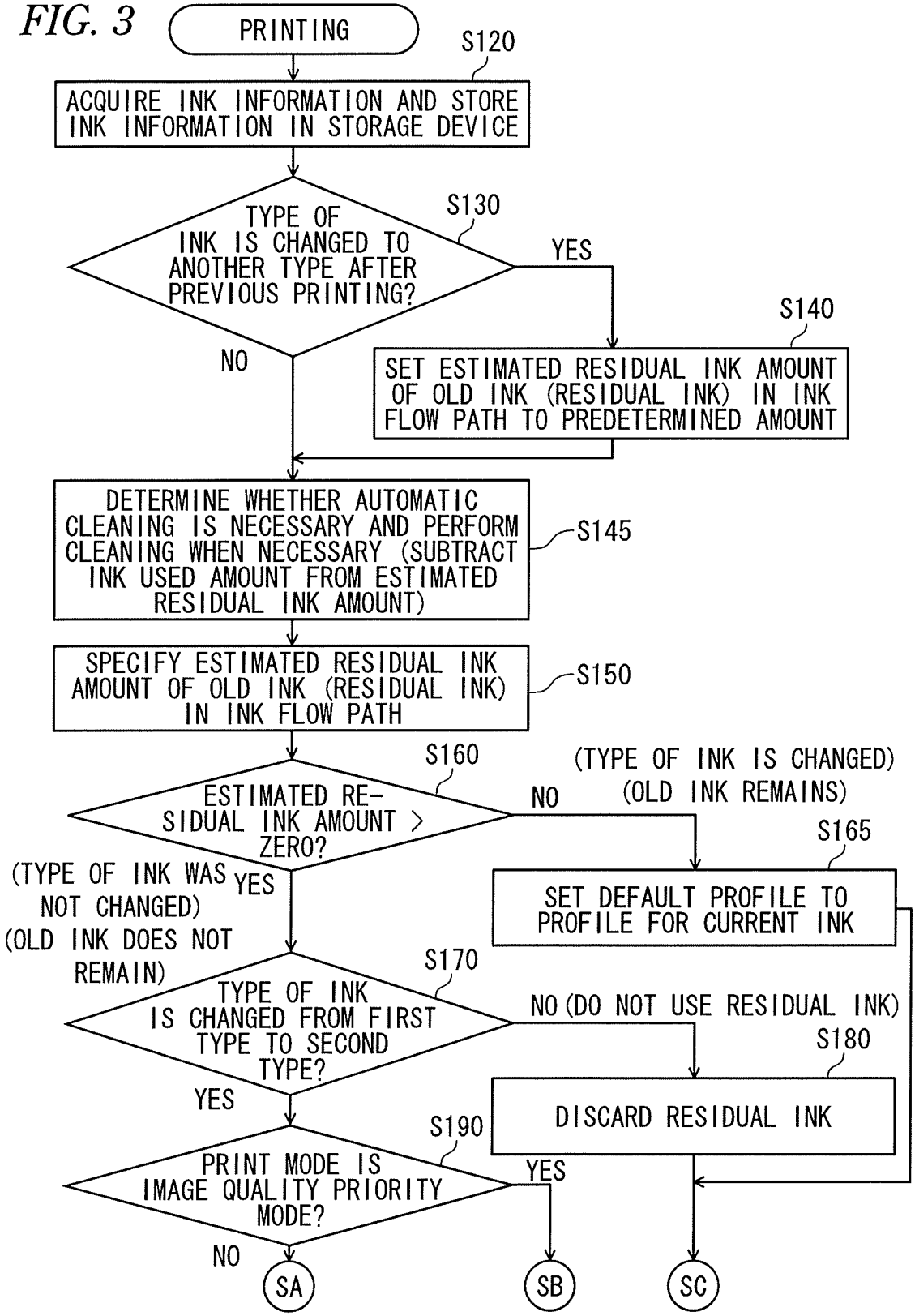
FIG. 3 is a flowchart illustrating an example of a printing process.
Figure 4:
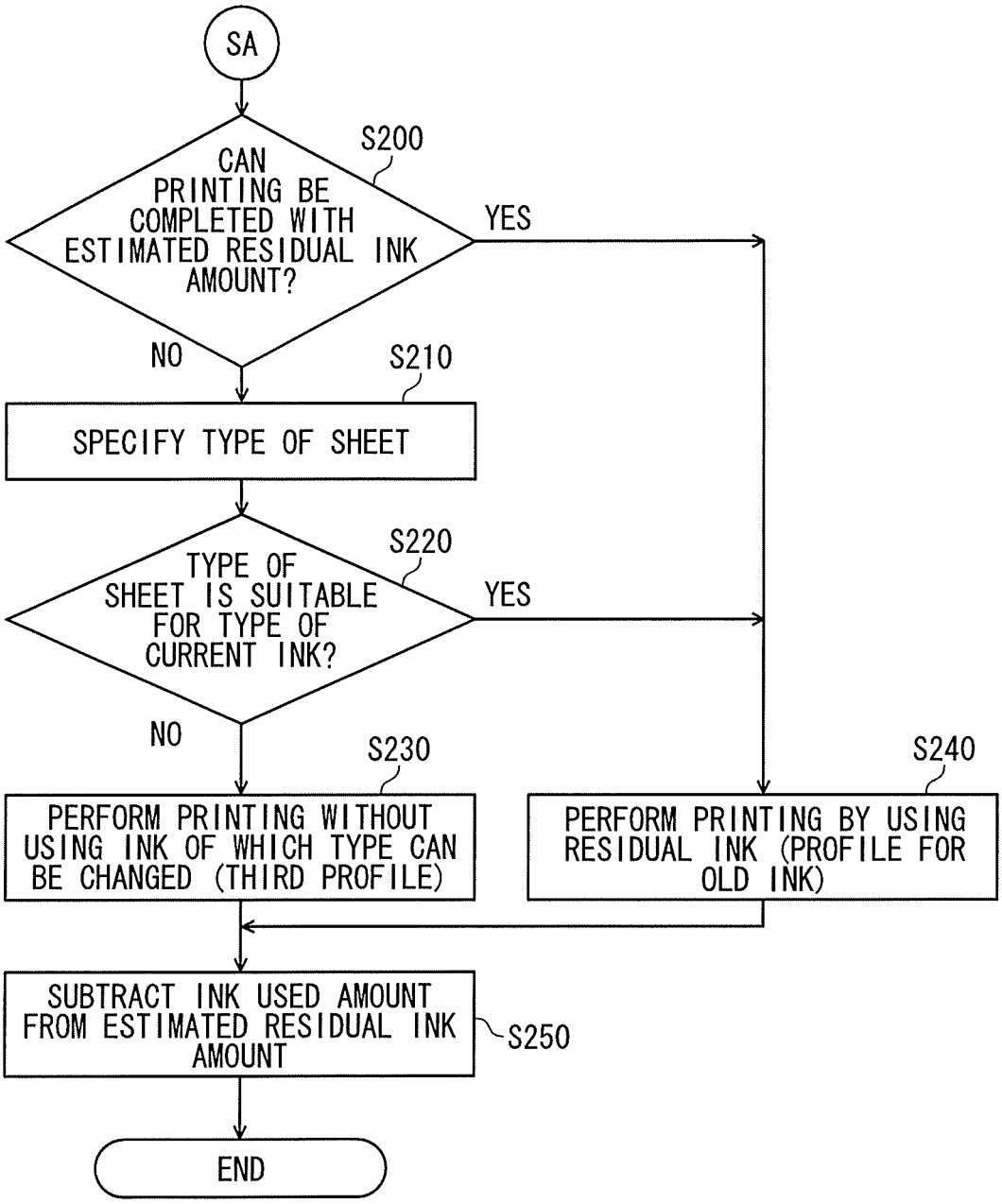
FIG. 4 is a flowchart illustrating an example of a printing process.
Figure 5:
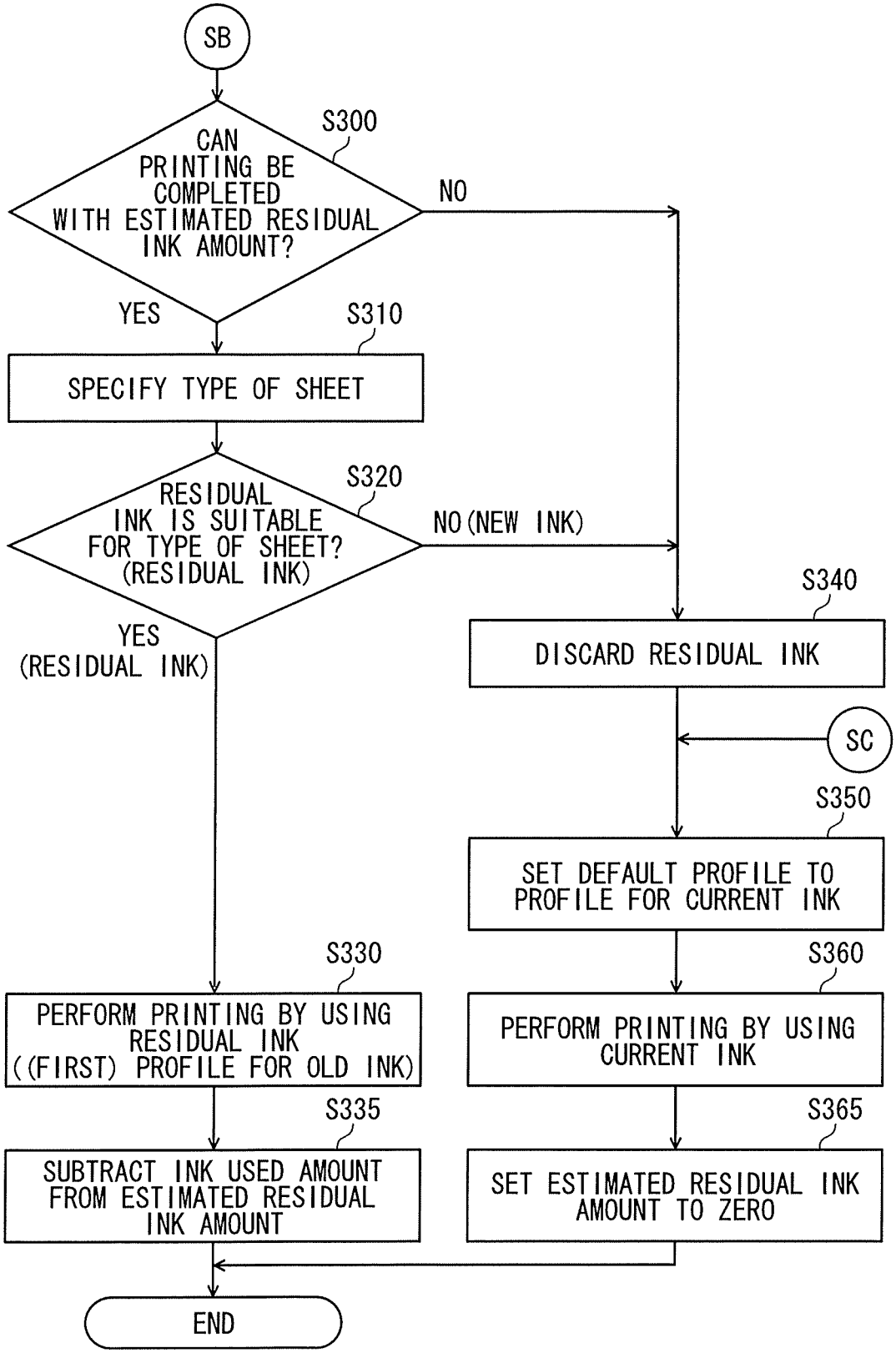
FIG. 5 is a flowchart illustrating an example of a printing process.

FIGS. 3 to 5 are flowcharts illustrating an example of the printing process executed by the multifunction device 200. The processor 210 of the controller 299 (FIG. 1) receives a print instruction from the user. The processor 210 starts a printing process based on the print instruction. The method for inputting the print instruction may be any method. For example, the user may transmit the print instruction to the multifunction device 200 by using a computer (not illustrated) that can communicate via the communication interface 270. The user may input the print instruction by operating the operation unit 250. Hereinafter, it is assumed that the user operates the operation unit 250 to input a print processing instruction.

In the present embodiment, the print instruction includes information designating image data for the printing and information on various print settings. The information on the print settings includes information designating the print mode and information designating the type of sheet. Hereinafter, the image data for the printing is also referred to as target data. As the target data, for example, image data stored in a memory card MC connected to the communication interface 270 is designated. The print mode is selected from a plurality of modes including an "image quality priority mode" and a "speed priority mode". The image quality priority mode is, for example, a print mode in which the print head 332 ejects ink droplets onto sheet in a unidirectional scanning process. The speed priority mode is, for example, a print mode in which the print head 332 ejects ink droplets onto sheet in each of bidirectional scanning process. The type of sheet is selected from "plain sheet" and "glossy sheet".

In S120, the processor 210 instructs the print execution unit 300 to acquire the ink information. The control circuit 360 causes the memory readers 326K, 326C, 326M, and 326Y to read the ink information, and supplies the read ink information to the controller 299 according to the instruction. The processor 210 acquires from the print execution unit 300 the ink information of each of the four ink cartridges mounted in the cartridge mounting unit 320. Then, the processor 210 stores the acquired ink information in the non-volatile storage 230. As described later, in the next printing process, the processor 210 refers to the ink information in the non-volatile storage 230 as the ink information in the previous printing process.

In S130, the processor 210 uses the ink information on the black ink acquired in S120 to determine whether the type of black ink is changed after the previous printing. Hereinafter, the black ink contained in the ink cartridge mounted in the cartridge mounting unit 320 is also referred to as the current ink. The type of black ink indicated by the ink information in S120 is called the type of current ink. The processor 210 specifies the type of current ink in the previous printing process with reference to the ink information stored in the non-volatile storage 230 in S120 of the previous printing process. Then, when the type of current ink in the previous printing process is different from the type of current ink in the current printing process, the processor 210 determines that the type of black ink is changed to another type after the previous printing.

When the type of black ink is changed after the previous printing (S130: YES), in S140, the processor 210 updates the estimated residual ink amount information 237 so that the estimated residual ink amount 237$x$ (FIG. 1) indicates a predetermined amount that is larger than zero corresponding to the volume of the ink flow path 315K. Then, the process proceeds to S145. When the type of black ink was not changed after the previous printing (S130: NO), the processor 210 skips S140 and proceeds to S145.

In S145, the processor 210 determines whether automatic cleaning is necessary. In the present embodiment, the necessity of the automatic cleaning is determined according to a predetermined cleaning execution condition. The cleaning execution conditions are experimentally determined to prevent the clogging of the nozzles Nz with the dried ink. For example, the cleaning execution condition may be that a predetermined number of days elapsed since the previous printing. When the cleaning execution condition is satisfied, the processor 210 supplies a flushing execution instruction to the print execution unit 300. The control circuit 360 of the print execution unit 300 causes the print head 332 to perform flushing according to the instruction. The processor 210 updates the estimated residual ink amount information 237 so that the estimated residual ink amount 237$x$ (FIG. 1) indicates a value obtained by subtracting the amount of black ink used by flushing from the current estimated residual ink amount 237$x$. The used amount by flushing is determined in advance. Then, S145 ends. When the cleaning condition is not satisfied, the processor 210 ends S145 without instructing the flushing to the print execution unit 300.

In S150, the processor 210 specifies the estimated residual ink amount 237*x* by referring to the estimated residual ink amount information 237 (FIG. 1). In S160, the processor 210 determines whether the estimated residual ink amount 237*x* is larger than zero.

In the present embodiment, one cleaning (S145) is assumed to use only a portion of the ink in the ink flow path 315K. When the type of black ink is changed after the previous printing, since the estimated residual ink amount 237*x* is larger than zero (S140), the determination result of S160 is YES. When the printing process is performed one or more times after the type of black ink is changed, and the old ink not used for the printing remains in the ink flow path 315K, the determination result of S160 is YES. When the type of black ink is not changed, since the estimated residual ink amount 237*x* is equal to or smaller than zero, the determination result of S160 is NO. When the printing process is performed one or more times after the type of black ink is changed, and the entire old ink is used for the printing and the old ink does not remain in the ink flow path 315K, the determination result of S160 is NO. One cleaning (S145) may use the entire ink in the ink flow path 315K. When the type of black ink is changed after the previous printing, and the entire old ink is used for cleaning and the old ink does not remain in the ink flow path 315K, the determination result of S160 is NO.

When the determination result in S160 is YES, in S170, the processor 210 determines whether the type of black ink is changed from the first type to the second type. In the present embodiment, when the residual ink type 238*x* indicates the first type (herein, a dye) and the type of current ink indicates the second type (herein, a pigment), the processor 210 determines that the type of black ink is changed from the first type to the second type.

When it is determined that the type of black ink is changed from the first type to the second type (S170: YES), in S190, the processor 210 determines whether the print mode designated by the print instruction is the "image quality priority mode". When the print mode is different from the "image quality priority mode" (S190: NO), in S200 (FIG. 4), the processor 210 calculates the estimated value of the amount of black ink necessary for the printing by analyzing the target data and determines whether the printing can be completed with the estimated residual ink amount 237*x*. The method of calculating the estimated value of the amount of black ink necessary for the printing may be various methods. In the present embodiment, the processor 210 converts the target data into bitmap data with a predetermined print resolution. Then, the processor 210 specifies the amount of each ink for each pixel by referring to a predetermined correspondence relationship between the color value of one pixel (for example, the gradation value of RGB) and the amount of each ink of one pixel. The processor 210 calculates a total value of the amounts of black ink of all the pixels. The total value is used as an estimated value (also referred to as estimated used amount) of the amount of black ink necessary for the printing.

The processor 210 determines that printing can be completed with the estimated residual ink amount 237*x* when the estimated residual ink amount 237*x* is equal to or larger than the estimated used amount. In this case (S200: YES), in S240, the processor 210 causes the print execution unit 300 to execute printing using the residual ink. In the present embodiment, the processor 210 generates print data to be supplied to the print execution unit 300 by using the target data. The print data is data in a data format that can be interpreted by the control circuit 360 of the print execution unit 300. The processor 210 supplies the generated print data to the print execution unit 300. The control circuit 360 of the print execution unit 300 controls the printing mechanism 370 according to the received print data. Thus, the image is printed on the sheet.

Various methods can be employed as a method of generating the print data. In the present embodiment, the processor 210 generates the print data by executing a resolution converting process, a color converting process on resolution-converted image data, and a halftoning process using color-converted image data. The resolution converting process is a process of converting the resolution of the target data into a predetermined print resolution for the printing. The data format of the target data may be a format different from the bitmap format (for example, the target data may be data described in a page description language). In this case, the processor 210 executes a process (for example, a rasterizing process) for converting the target data into the bitmap data with the print resolution. The image data with the print resolution to be generated is bitmap data of a predetermined input color space (for example, RGB).

The color converting process is a process of converting the color value of each pixel from the color value of the input color space to the color value of the print color space which is a color space for printing. The print color space is a color space represented by color components corresponding to the ink used by the print execution unit 300. In the present embodiment, as the print color space, a KCMY color space (also referred to as a first color space) in the case of using dye black ink and a KCMY color space (also referred to as a second color space) in the case of using pigment black ink can be used. In the present embodiment, a CMY color space (also referred to as a third color space) in which printing is performed without using the black ink can be used.

The profiles 233, 234, and 235 (FIG. 1) are data (for example, a look-up table) indicating the correspondence relationship between color values in the input color space and color values in the print color space. The first profile 233 indicates the correspondence relationship with the first color space (dye black), the second profile 234 indicates the correspondence relationship with the second color space (pigment black), and the third profile 235 indicates the correspondence relationship with the third color space (CMY). When S240 is performed, the residual ink is dye black ink. Therefore, the processor 210 executes the color converting process by referring to the first profile 233. Accordingly, the color conversion suitable for the type of residual ink is performed.

A halftoning process may be processes of various methods such as an error diffusion method or a method using a dither matrix. The processor 210 generates print data by using data representing the result of the halftoning process.

In S250, the processor 210 updates the estimated residual ink amount information 237 so that the estimated residual ink amount 237*x* indicates a value obtained by subtracting the actual used amount of black ink used for the printing from the current estimated residual ink amount 237*x*. The method of calculating the actual used amount (also referred to as the actual used amount) of the black ink used for the printing may be various methods. In the present embodiment, the processor 210 specifies the used amount of black ink of each pixel by analyzing the print data. Then, the processor 210 calculates the total value of the used amounts of black ink of all the pixels as the actual used amount. As the estimated residual ink amount information 237 is updated in S250, the processor 210 ends the printing process.

When the estimated residual ink amount 237*x* is smaller than the estimated used amount in S200 (S200: NO), the processor 210 determines that printing cannot be completed with the estimated residual ink amount 237*x*. In this case, in step S210, the processor 210 specifies the type of sheet designated by the print instruction. In S220, the processor 210 determines whether the type of sheet is suitable for the type of current ink. In the present embodiment, when the suitability (FIG. 2) of the combination of the type of current ink and the type of sheet is A or B, it is determined that the type of sheet is suitable for the type of current ink. When the suitability is C, it is determined that the type of sheet is not suitable with the type of current ink.

When it is determined that the type of sheet is suitable for the type of current ink (S220: YES), the processor 210 executes S240 and S250 described above and ends the printing process. Accordingly, the printing using the residual ink is performed. In this case, since the estimated residual ink amount 237*x* is smaller than the estimated used amount, the residual ink is used for the printing, and subsequently, the current ink is used.

When it is determined that the type of sheet is not suitable for the type of current ink (S220: NO), the processor 210 causes the print execution unit 300 to execute the printing without using the ink of which type can be changed (S230: NO). In the present embodiment, the printing using three types of the CMY ink without using the black ink is performed. Similarly to S240, the processor 210 generates the print data and supplies the generated print data to the print execution unit 300. Herein, the processor 210 uses the third profile 235 corresponding to the third color space (CMY) in the color converting process. Accordingly, appropriate print data using the three types of CMY ink without using the black ink are generated.

After the printing in S230, the processor 210 updates the estimated residual ink amount information 237 in S250. S250 is performed similarly to the case where the printing of S240 is performed. Then, the printing process ends. Herein, the residual ink is not discarded. The residual ink can be used in the subsequent printing. Accordingly, it is possible to effectively use the ink for the printing.

When the print mode is the "image quality priority mode" in S190 of FIG. 3 (S190: YES), in S300 (FIG. 5), the processor 210 calculates the amount of black ink necessary for the printing by analyzing the target data and determines whether or not the printing can be completed with the estimated residual ink amount 237*x*. The process of S300 is the same as the process of S200 (FIG. 4).

When it is determined that the printing can be completed with the estimated residual ink amount 237*x* (S300: YES), in S310, the processor 210 specifies the type of sheet designated by the print instruction. In S320, the processor 210 determines whether the residual ink is suitable for the type of sheet. In the present embodiment, when the suitability (FIG. 2) of the combination of the residual ink type 238*x* and the type of sheet is A or B, it is determined that the residual ink is suitable for the type of sheet. When the suitability is C, it is determined that the residual ink is not suitable for the type of sheet.

When it is determined that the residual ink is suitable for the type of sheet (S320: YES), the processor 210 causes the print execution unit 300 to execute printing using the residual ink in S330, and updates the estimated residual ink amount information 237 in S335. The processes of S330 and S335 are the same as the processes of S240 and S250 of FIG. 4. The printing process ends as S330 and S335 ends.

When it is determined in S320 that the residual ink is not suitable for the type of sheet (S320: NO), in S340, the processor 210 executes a process of discarding the residual ink. Specifically, the processor 210 supplies an instruction for discarding the residual ink to the print execution unit 300. The control circuit 360 of the print execution unit 300 discards the residual ink according to the instruction. The process of discarding the residual ink may be an arbitrary process of discarding the residual ink in the ink flow path 315K. For example, the process of discarding the residual ink may be a process of causing the print head 332 to perform flushing. Alternatively, the process of discarding the residual ink may be a purging process using the capping device 352. In any case, the processor 210 may determine the discarding amount by using the estimated residual ink amount 237*x* and may instruct the print execution unit 300 to discard the determined discarding amount of ink. The control circuit 360 may execute the process of discarding the discarding amount of ink according to the instruction. Herein, the discarding amount may be determined to various values of the estimated residual ink amount 237*x* or more. For example, the discarding amount may be determined to be an amount of the estimated residual ink amount 237*x* or more and the volume or less of the ink flow path 315K. Alternatively, the discarding amount may be a predetermined amount (for example, the volume of the ink flow path 315K).

In S350, the processor 210 sets a default profile to a profile suitable for the type of current ink. For example, when the type of current ink is the first type ink, the default profile is set to the first profile 233 corresponding to the first type ink. When the type of current ink is the second type ink, the default profile is set to the second profile 234 corresponding to the second type ink.

In S360, the processor 210 causes the print execution unit 300 to execute the printing using the current ink. Similarly to S240 (FIG. 4), the processor 210 generates print data and supplies the generated print data to the print execution unit 300. Herein, the processor 210 uses the default profile, that is, the profile corresponding to the current ink in the color converting process (first profile 233 or second profile 234). Accordingly, appropriate print data using the four inks of KCMY including the current ink are generated.

After the printing of S360, in S365, the processor 210 updates the estimated residual ink amount information 237 so that the estimated residual ink amount 237*x* is zero. Then, the printing process ends.

When the estimated residual ink amount 237*x* is smaller than the estimated used amount at S300 (S300: NO), the processor 210 executes S340, S350, S360, and S365 described above, and ends the printing process.

When it is determined in S170 (FIG. 3) that the type of black ink is changed from the second type to the first type (S170: NO), the processor 210 determines to not use the residual ink for the printing. In this case, in step S180, the processor 210 supplies an instruction to discard the residual ink to the print execution unit 300. The process of S180 is the same as the process of S340 of FIG. 5. Then, the processor 210 executes S350, S360, and S365 of FIG. 5 to end the printing process.

When the determination result in S160 of FIG. 3 is NO, in S165, the processor 210 updates the residual ink type information 238 so that the residual ink type 238*x* represents the type of current ink. Then, the processor 210 executes S350, S360, and S365 of FIG. 5 to end the printing process.

As described above, in the present embodiment, the multifunction device 200 (FIG. 1) includes the inkjet-type print execution unit 300 and the controller 299 that controls the print execution unit 300. The print execution unit 300 includes a print head 332, an ink supply unit 320, and ink flow paths 315K, 315C, 315M, and 315Y. The print head 332 includes a plurality of nozzles Nz configured to eject ink. The ink supply unit 320 is configured to supply the ink to the print head 332. Specifically, the ink supply unit 320 is configured so that a cartridge containing the ink is mounted. The ink flow paths 315K, 315C, 315M, and 315Y connect the ink supply unit 320 and the print head 332.

The processor 210 of the controller 299 determines in S130, S140, S145, S150, and S160 of FIG. 3 whether the type of ink supplied by the ink supply unit 320 is changed. Then, when it is determined that the type of ink is changed (S160: YES), the processor 210 determines in S170 and S190 of FIG. 3 and S200 and S220 of FIG. 4 or in S170 and S190 of FIG. 3 and S300 and S320 of FIG. 5 whether to use the residual ink remaining in the ink flow path 315K for the printing. Herein, cases of determining to use the residual ink for the printing are the following three cases. (1) S170: YES, S190: YES, S300: YES, and S320: YES; (2) S170: YES, and S190: NO, and S200: YES; and (3) S170: YES, and, S190: NO, and S200: NO, and S220: YES.

When it is determined to use the residual ink for the printing, the processor 210 causes the print execution unit 300 to execute new printing using the residual ink (that is, printing to be performed from now on and, in the present embodiment, the current printing) (S240 (FIG. 4) and S330 (FIG. 5)).

The processor 210 executes the discarding process for discarding the residual ink until the new printing is performed in response to the determination to not use the residual ink for the printing (S180 (FIG. 3) and S340 (FIG. 5)).

As described above, since the residual ink remaining in the ink flow path 315K can be used for the printing, the ink can be effectively used for the printing when the type of ink is changed.

As described in S190 of FIG. 3, the processor 210 determines whether to use the residual ink for the printing, by using the setting regarding the image quality for the new printing. Thus, the new printing is performed appropriately. Specifically, when the print mode is not the image quality priority mode (S190: NO), the process of FIG. 4 is executed. In the process of FIG. 4, when the estimated residual ink amount 237*x* is equal to or larger than the estimated used amount (S200: YES), it is determined to use the residual ink for the printing regardless of the type of sheet. As described above, when the print mode is not the image quality priority mode, the use of the residual ink according to the printing is prioritized, so that it is possible to effectively use the ink for the printing. On the other hand, when the print mode is the image quality priority mode (S190: YES), the process of FIG. 5 is executed. In the process of FIG. 5, even when the estimated residual ink amount 237*x* is equal to or larger than the estimated used amount (S300: YES), when it is determined that the type of residual ink is not suitable for the type of sheet (S320: NO), it is determined to not use the residual ink for the printing. As described above, when the print mode is the image quality priority mode, the printing with a low image quality is prevented. Then, when it is determined that the type of residual ink is suitable for the type of sheet (S320: YES), it is determined to use the residual ink for the printing. As described above, when the print mode is the image quality priority mode, the printing is performed with an appropriate image quality.

As described in S210 and S220 of FIG. 4 and S310 and S320 of FIG. 5, the processor 210 determines whether to use the residual ink for the printing, by using the type of sheet used for the new printing. In this manner, since the determination suitable for the type of sheet used for the new printing is performed, the printing can be appropriately performed. Specifically, in the process of FIG. 4, when the type of current ink used subsequently to the residual ink is not suitable for the type of sheet, it may be determined to not use the residual ink for the printing (S220: NO). In the process of FIG. 5, when the type of residual ink is not suitable for the type of sheet, it may be determined to not use the residual ink for the printing (S320: NO).

As described in S170 of FIG. 3, the condition for determining to use the residual ink for the printing includes a condition that the type of ink is changed from a specific first type ink to a specific second type ink (in the present embodiment, the first type ink is dye ink, and the second type ink is pigment ink). Therefore, when the type of ink is changed from the specific first type of ink to the specific second type of ink, it is possible to effectively use the ink for the printing.

When the type of ink is changed from the second type ink to the first type ink (FIG. 3, S170: NO), the processor 210 determines to not use the residual ink for the printing. Then, in S180, the processor 210 executes a discarding process for discarding the residual ink. The discarding process of S180 is performed after the start of the printing process, that is, after reception of a new printing instruction. Therefore, it is possible to appropriately discard the residual ink remaining in the ink flow path 315K at the stage of receiving the new printing instruction.

As described in S230 and S240 of FIG. 4 and S330 and S360 of FIG. 5, the processor 210 causes the print execution unit 300 to execute the printing by using a profile that defines the correspondence relationship between an input color space which is a color space of image data for the printing and a color space including color components corresponding to ink. Then, as described in S350 and S360 of FIG. 5, when the printing using the changed ink is executed by the print execution unit 300, the processor 210 causes the print execution unit 300 to execute the printing by using the profile associated with the type of changed ink. Therefore, the printing suitable for the type of changed ink is performed.

As described in S200 and S220 of FIG. 4, even when the estimated residual ink amount 237*x* is smaller than the estimated used amount (S200: NO), when it is determined to use the residual ink for the printing (S220) (YES), the processor 210 causes the print execution unit 300 to execute the entire printing in S240. Thus, the processor 210 causes the print execution unit 300 to execute the new printing so that the changed ink is used subsequently to the use of the residual ink. Therefore, even when the estimated residual ink amount 237*x* is smaller than the amount of ink (that is, the estimated used amount) used for the new printing, it is possible to effectively use the ink for the printing.

In the present embodiment, after the type of ink is changed, it is determined whether to use the residual ink for the printing each time when the printing instruction is received until the estimated residual ink amount 237*x* becomes zero. Therefore, when the volume of the ink flow path 315K is large, it is possible to effectively use the residual ink for the printing.

B. Modified Examples (1) The method of determining whether or not the type of ink is changed may be various other methods instead of the method using the information read from the memory fixed to the ink cartridge (for example, the memory 406Ka of the ink cartridge 400Ka). For example, when the user changed the type of ink, the user may input the type of changed ink (for example, a model number of the ink) by operating the operation unit 250. The processor 210 may use the input information to determine whether the type of ink has been changed.

(2) The condition for determining to use the residual ink for the printing may be various other conditions instead of the conditions described in FIGS. 3 to 5. For example, S190 (FIG. 3) may be omitted. In this case, when the determination result of S170 is YES, the process may proceed to S200 of FIG. 4. Alternatively, the process may proceed to S300 of FIG. 5. S210 and S220 of FIG. 4 may be omitted. In this case, when the determination result of S200 is NO, the process may proceed to S230. S310 and S320 of FIG. 5 may be omitted. In this case, when the determination result of S300 is "YES", the process may proceed to S330.

The determination condition for the determination result in S170 of FIG. 3 to be YES (that is, the condition included in the condition for determining that the residual ink is used for the printing) may be various other conditions instead of the condition that the type of ink is changed from the dye (first type ink) to the pigment (second type ink). For example, the determination condition of S170 may be that the type of ink is changed from pigment to dye. In general, the determination condition of S170 may be that the type of ink is changed from a specific first type ink to a specific second type ink. Herein, it is preferable that the first type ink before the change is ink that is suitable for many types of sheet, compared to the second type ink after the change. When the ink that is suitable for many types of sheet remains in the ink flow path, it is possible to perform appropriate printing by using the residual ink. S170 may be omitted. In this case, when the determination result of S160 is YES, the process may proceed to S190.

(3) The procedure of the printing process may be other various procedures instead of the procedures of FIGS. 3 to 5. For example, when the estimated residual ink amount 237*x* is smaller than the estimated used amount in S200 of FIG. 4 (S200: NO), the same processes as S340, S350, S360, and S365 of FIG. 5 may be executed. When the determination result of S170 of FIG. 3 is "NO", the processor 210 may execute the following processes. That is, the processor 210 determines whether the type of residual ink is suitable for the type of sheet. When the type of residual ink is suitable for the type of sheet, the processor 210 determines to use the residual ink for the printing and causes the print execution unit 300 to execute the printing using the residual ink. When the type of residual ink is not suitable for the type of sheet, the processor 210 determines to not use the residual ink for the printing and causes the print execution unit 300 to execute the printing not using the ink of which type can be changed similarly to S230 of FIG. 4.

The target data may be any data representing an image. For example, the target data may be data represented in a print color space. In this case, the processor 210 may generate print data without performing a color converting process (thus, a process using a profile). In S200 (FIG. 4) and S300 (FIG. 5), the estimated used amount is calculated by using the correspondence relationship prepared for calculation of the estimated used amount (specifically, the correspondence relationship between the color value of the pixel and the amount of each ink). Instead of such correspondence relationship, the estimated used amount may be calculated by using a predetermined profile prepared for generation of the print data. Herein, as the profile, a profile is used in which a print color space including a color component (black in the above-described embodiment) corresponding to the ink of which type can be changed and an input color space are associated with each other. In the above-described embodiment, a predetermined one of the first profile 233 and the second profile 234 may be used to calculate the estimated used amount.

In the embodiment of FIGS. 3 to 5, the determination of whether to use the residual ink for the printing is performed after reception of a new printing instruction. Alternatively, when the type of ink is changed, the processor 210 may determine whether to use the residual ink for the printing, regardless of whether the new printing instruction is received. For example, the processor 210 may periodically acquire the ink information from the print execution unit 300. Then, the processor 210 may execute a process of determining whether to use the residual ink for the printing, in response to the change of the type of ink. In this case, the determination may be made without using the information included in the print instruction.

(4) The configuration of the print execution unit 300 may be other various configurations instead of the configuration illustrated in FIG. 1. For example, the ink of which type can be changed is not limited to black ink, but may be ink of one or more arbitrary colors. The buffer tanks 340K, 340C, 340M, and 340Y may be omitted. The ink supply tubes 310K, 310C, 310M, and 310Y may be omitted, and the cartridge mounting unit 320 may be fixed to the carriage unit 330. In this case, the carriage unit 330 includes an ink flow path connecting the cartridge mounting unit 320 and the print head 332. Instead of the cartridge mounting unit 320 for mounting the ink cartridge, an ink tank for each ink color may be connected to the ink supply tubes 310K, 310C, 310M, and 310Y. Then, the user may refill the ink tank. Herein, the user may refill the ink tank for one ink color with ink arbitrarily selected from a plurality of types of ink (for example, dye ink and pigment ink). In this case, the user may input the type (for example, model number) of the refilled ink by operating the operation unit 250. The processor 210 can use the input information to determine whether the type of ink is changed. In such a configuration, the ink tank is an example of the ink supply unit. The ink usable for the printing may be one or more arbitrary number of inks instead of four color inks of KCMY.

Devices (specifically, the guide rails 382 and 384, the pulleys 395 and 396, the belt 397, the carriage motor 398) for moving the carriage unit in the scanning direction may be omitted. Then the print head may include a nozzle row configured with a plurality of nozzles aligned along a direction perpendicular to the transporting direction over a length substantially equal to the width of the sheet. The print head 332 may include a plurality of nozzle rows for a plurality of inks, which are aligned in the transporting direction. A printer provided with such a print head is also called a line printer. The line printer performs printing without moving the print head. The print execution unit 300 may be configured to print an image by ejecting ink on various sheets such as sheet.

(5) The configuration of the printer may be various other configurations instead of the configuration of the multifunction device 200 of FIG. 1. For example, the scanner unit 280 may be omitted. The controller 299 may be accommodated in another case different from the case of the print execution unit 300. The controller 299 may be communicably connected to the print execution unit 300. In this case, the whole of the controller 299 and the print execution unit 300 is an example of a printer. Herein, the controller 299 may be various data processing devices such as a personal computer and a smartphone. A plurality of devices (for example, computers) that can communicate with each other via a network may provide, as a whole, functions of data processing for the printing by the controller by partly sharing the functions of data processing for the printing (a system including these devices corresponds to a controller).

In each of the above-described embodiments, a portion of the configuration realized by hardware may be replaced by software, and conversely, a portion or all of the configurations realized by software may be replaced by hardware. For example, the function of generating the print data by using the target data may be realized by a dedicated hardware circuit.

When a portion or all of the functions of the present invention are realized by a computer program, the program may be provided in a form of being stored in a computer-readable recording medium (for example, a non-temporary recording medium). The program may be used in a state where the program is stored on the same or different recording medium (computer-readable recording medium) as provided. The "computer-readable recording medium" is not limited to a portable recording medium such as a memory card and a CD-ROM, but the computer-readable recording medium may include internal storage devices in the computer such as various ROMs and external storage devices connected to the computer such as hard disk drives.

Heretofore, while the present invention has been described based on the embodiments and modified examples, the above-described embodiments of the present invention are provided for the purpose of facilitating the understanding of the present invention and do not limit the present invention. The present invention can be changed and modified without departing from the spirit thereof, and the present invention includes equivalents thereof.

The technology disclosed in the present specification can be realized as the following application examples.

APPLICATION EXAMPLE 1

An inkjet printer including: a print execution unit that executes printing; and a controller that controls the print execution unit. The print execution unit includes: a print head having a plurality of nozzles configured to eject ink; an ink supply unit that is configured to supply ink to the print head; and an ink flow path that connects the ink supply unit and the print head. The controller is configured to: determine whether a type of ink supplied by the ink supply unit is changed; determine whether to use a residual ink which is ink before change remaining in the ink flow path in response to be determined that the type of the ink is changed; control the print execution unit to execute new printing using the residual ink in response to be determined to use the residual ink for the printing; and execute a discarding process for discarding the residual ink before the new printing is performed in response to be determined to not use the residual ink for the printing.

According to this configuration, since the residual ink remaining in the ink flow path can be used for the printing, when the type of ink is changed, it is possible to effectively use the ink for the printing.

APPLICATION EXAMPLE 2

The inkjet printer according to the Application Example 1, wherein the controller is configured to determine whether to use the residual ink for the printing by referring to a setting regarding image quality for the new printing.

According to this configuration, since the determination suitable for the setting regarding the image quality for the new printing is performed, it is possible to appropriately execute the new printing.

APPLICATION EXAMPLE 3

The inkjet printer according to the Application Example 1, wherein the controller is configured to determine whether to use the residual ink for the printing by referring to a type of print medium used for the new printing.

According to this configuration, since the determination suitable for the type of print medium used for the new printing is performed, it is possible to appropriately execute the new printing.

APPLICATION EXAMPLE 4

The inkjet printer according to the Application Example 1, wherein a condition for determining to use the residual ink for the printing includes a condition that the type of the ink is changed from a specific first type of ink to a specific second type of ink.

According to this configuration, when the type of ink has been changed from the specific first type ink to the specific second type ink, it is possible to effectively use the ink for the printing.

APPLICATION EXAMPLE 5

The inkjet printer according to the Application Example 1, wherein, in a case where the type of the ink is changed from the second type of ink to the first type of ink, the controller determines to not use the residual ink for the printing, and executes the discarding process after reception of a new print instruction.

According to this configuration, it is possible to appropriately discard the residual ink remaining in the ink flow path at the stage of receiving the new printing instruction.

APPLICATION EXAMPLE 6

The inkjet printer according to the Application Example 1, wherein the controller controls the print execution unit to execute the printing by using a profile that defines a correspondence relationship between a specific color space and a color space including a color component corresponding to the ink, and wherein the controller controls the print execution unit to execute the printing by using the profile associated with a type of the changed ink in response to be determined to use changed ink.

According to this configuration, it is possible to execute printing suitable for the type of changed ink.

APPLICATION EXAMPLE 7

The inkjet printer according to the Application Example 1, wherein, in a case where determined to use the residual ink for the printing and an amount of the residual ink is smaller than an amount of the ink to be used for the new printing, the controller controls the print execution unit to execute the new printing so that the changed ink is used subsequently to the use of the residual ink.

According to this configuration, even when the amount of residual ink is smaller than the amount of ink used for the new printing, it is possible to effectively use the ink for the printing.

APPLICATION EXAMPLE 8

The inkjet printer according to the Application Example 1, wherein the print execution unit executes printing by using a plurality of colors of ink including a specific color, and wherein, in a case where determined that the type of the specific color ink is changed and an amount of the residual ink corresponding to the specific color ink is smaller than an amount of ink to be used for the new printing, the controller controls the print execution unit to execute the new printing by using the ink other than the ink of the specific color without discarding the residual ink corresponding to the ink of the specific color.

According to this configuration, even when the amount of residual ink is smaller than the amount of ink used for the new printing, it is possible to effectively use the ink for the printing.

The technology disclosed in this specification can be realized in various aspects. For example, the technology may be realized in a form of a control method and a controller of a printer, a printer including a controller and a print execution unit, a computer program for realizing these methods or functions of devices, a recording medium (for example, a non-temporary recording medium) recording the computer program, and the like.

What is claimed is:

1. An inkjet printer comprising:

a print execution unit that executes printing; and a controller that controls the print execution unit, wherein the print execution unit includes:

a print head having a plurality of nozzles configured to eject ink;

an ink supply unit that is configured to supply ink to the print head; and an ink flow path that connects the ink supply unit and the print head, wherein the print execution unit executes printing by using a plurality of colors of ink including a specific color and a set of multiple colors, wherein the controller is configured to:

determine whether a type of ink supplied by the ink supply unit is changed from a first type of ink of the specific color to a second type of ink of the specific color;

in response to determining that the type of ink is changed from the first type to the second type, determine whether to use a residual ink remaining in the ink flow path for new printing, the residual ink being the first type of ink of the specific color, wherein determining whether to use the residual ink for the new printing includes:

determining an amount of the residual ink remaining in the ink flow path; and determining whether the amount of the residual ink is smaller than an amount of ink to be used for the new printing; and control the print execution unit to execute the new printing, including:

in a case where it is determined that the amount of the residual ink is not smaller than the amount of ink to be used for the new printing, control the print execution unit to execute the new printing by using the residual ink and using a first color profile; and in a case where it is determined that the amount of the residual ink is smaller than the amount of ink to be used for the new printing, control the print execution unit to execute the new printing by using the set of multiple colors and a second color profile different from the first color profile without discarding the residual ink.

2. The inkjet printer according to claim 1, wherein the controller is configured to:

in a case where it is determined that the type of ink supplied by the ink supply unit is changed from the second type of ink of the specific color to the first type of ink of the specific color, execute a discharging process for discharging the residual ink.

3. The inkjet printer according to the claim 1, wherein the controller is configured to:

determine whether the print execution unit performs a cleaning operation before the new printing, the cleaning operation cleaning the plurality of nozzles;

in case where it is determined that the print execution unit performs the cleaning operation before the new printing, control the print execution unit to perform the cleaning operation; and after the cleaning operation, determine the amount of the residual ink remaining in the ink flow path.

* * * * *